US012798811B2

(12) United States Patent
Kodera

(10) Patent No.: US 12,798,811 B2
(45) Date of Patent: Nov. 17, 2026

(54) WORKPIECE INSERTION APPARATUS

(71) Applicant: TOKYO WELD CO., LTD., Tokyo-to (JP)

(72) Inventor: Katsuyoshi Kodera, Tokyo-to (JP)

(73) Assignee: TOKYO WELD CO., LTD., Tokyo-to (JP)

( * ) Notice: Subject to any disclaimer, the term of this patent is extended or adjusted under 35 U.S.C. 154(b) by 0 days.

(21) Appl. No.: 19/284,449

(22) Filed: Jul. 29, 2025

(65) Prior Publication Data

US 2026/0035114 A1 Feb. 5, 2026

(30) Foreign Application Priority Data

Jul. 30, 2024 (JP) ..... 2024-123572

(51) Int. Cl.
*B65B 35/56* (2006.01)
*B65B 5/08* (2006.01)
*B65B 35/10* (2006.01)

(52) U.S. Cl.
CPC ..... *B65B 35/56* (2013.01); *B65B 5/08* (2013.01); *B65B 35/10* (2013.01)

(58) Field of Classification Search
CPC ..... B65B 35/56; B65B 5/08; B65B 35/10
See application file for complete search history.

(56) References Cited

U.S. PATENT DOCUMENTS 6,621,261 B2 * 9/2003 Tsuchiya ..... G01R 3/00 324/756.05
2019/0389610 A1 * 12/2019 Saito ..... B65B 35/06

FOREIGN PATENT DOCUMENTS

CN 106184870 A * 12/2016 ..... B65B 15/04
JP 2000072108 A * 3/2000
JP 2001348006 A * 12/2001
(Continued)

OTHER PUBLICATIONS

Japanese Office Action issued in Patent application No. 2024-123572 dated Jan. 7, 2025.

*Primary Examiner* — Lucas E. A. Palmer
(74) *Attorney, Agent, or Firm* — Birch, Stewart, Kolasch & Birch, LLP

(57) ABSTRACT

A workpiece insertion apparatus that inserts workpieces into cavities of a carrier tape at a supply position, includes: a base that has an inclined surface that is inclined in such a manner that a portion of the inclined surface on a supply position side is lowest in a vertical direction; an index table that has a plurality of accommodation sections in which the workpieces are to be accommodated and extends along the inclined surface; a guide unit that has a guide surface, the guide surface being provided to cover an accommodation section positioned at a release position and a cavity positioned at the supply position; a workpiece transfer device that exerts a propulsive force on a workpiece in an accommodation section positioned at the release position to move the workpiece toward a cavity positioned at the supply position via a workpiece path defined by the inclined surface and the guide surface; and a posture correction magnet that exerts a magnetic force acting in an attraction direction including an upward direction component on a leading side end of ends of a workpiece that is positioned at the supply position, the leading side end being positioned on a cavity side when the workpiece is on the inclined surface.

7 Claims, 4 Drawing Sheets

(56) References Cited

FOREIGN PATENT DOCUMENTS

| | | | | |
|---|---|---|---|---|
| JP | 2018024473 | A | * | 2/2018 |
| JP | 2022-41106 | A | | 3/2022 |
| JP | 2022041106 | A | * | 3/2022 |

* cited by examiner

WORKPIECE INSERTION APPARATUS

CROSS-REFERENCE TO RELATED APPLICATIONS

This application is based upon and claims the benefit of priority from Japanese Patent Application No. 2024-123572, filed on Jul. 30, 2024; the entire contents of which are incorporated herein by reference.

TECHNICAL FIELD

The present disclosure relates to a workpiece insertion apparatus.

BACKGROUND ART

Japanese patent application publication No. 2022-41106 discloses an apparatus that can suction a workpiece from an accommodation section of an index table and then insert the workpiece into a cavity of a carrier tape in a stable manner.

SUMMARY OF THE INVENTION

In cases where vacuum suction and/or magnetic force is used to insert a workpiece into a cavity of a carrier tape, a relatively large force may be exerted on the workpiece, causing the workpiece to assume an unintended posture within the cavity. For example, the workpiece may assume an inclined posture in which the end of the workpiece on the direction of travel toward a cavity contacts the cavity bottom while the opposite end protrudes out of the cavity.

If a workpiece is not accommodated in a cavity in a proper orientation in this manner, there is concern that a top tape may not be properly applied to the carrier tape or that the workpiece may jump out of the cavity when the carrier tape is moved.

The present disclosure provides a technique advantageous for accommodating a workpiece in a cavity in a stable posture.

An aspect of the present disclosure is directed to a workpiece insertion apparatus that inserts workpieces into cavities of a carrier tape at a supply position, the workpiece insertion apparatus comprising: a base that has an inclined surface that is inclined in such a manner that a portion of the inclined surface on a supply position side is lowest in a vertical direction; an index table that has a plurality of accommodation sections in which the workpieces are to be accommodated and extends along the inclined surface; a guide unit that has a guide surface, the guide surface being provided to cover an accommodation section positioned at a release position and a cavity positioned at the supply position; a workpiece transfer device that exerts a propulsive force on a workpiece in an accommodation section positioned at the release position to move the workpiece toward a cavity positioned at the supply position via a workpiece path defined by the inclined surface and the guide surface; and a posture correction magnet that exerts a magnetic force acting in an attraction direction including an upward direction component on a leading side end of ends of a workpiece that is positioned at the supply position, the leading side end being positioned on a cavity side when the workpiece is on the inclined surface.

The workpiece insertion apparatus may comprise a workpiece insertion magnet that forms a magnetic field at the supply position, the workpiece insertion magnet may include: a first moving magnet located on a release position side with respect to the supply position; and a second moving magnet located on an opposite side from the release position with respect to the supply position, and a magnetic pole of a side of the first moving magnet facing the second moving magnet may be different from a magnetic pose of a side of the second moving magnet facing the first moving magnet.

The guide surface may support a top surface of a workpiece in the supply position in such a manner that the workpiece assumes a horizontal posture while being subject to the magnetic force.

The workpiece insertion apparatus may comprise a magnetizing device that magnetizes the leading side end of each of the workpieces to a specific pole before the workpieces housed in the plurality of accommodation sections reach the release position.

The workpiece transfer device and the posture correction magnet may apply the propulsive force and the magnetic force to the workpieces in such a manner that a workpiece floats from the carrier tape at the supply position while at least a part of the workpiece is positioned in a cavity, and the workpiece may be sent downstream from the supply position while at least part of the workpiece is positioned in the cavity as the carrier tape moves, and the workpiece lands in the cavity on a downstream side from the supply position.

According to the present disclosure, it is advantageous to accommodate a workpiece in a cavity in a stable posture.

DETAILED DESCRIPTION

Figure 1:
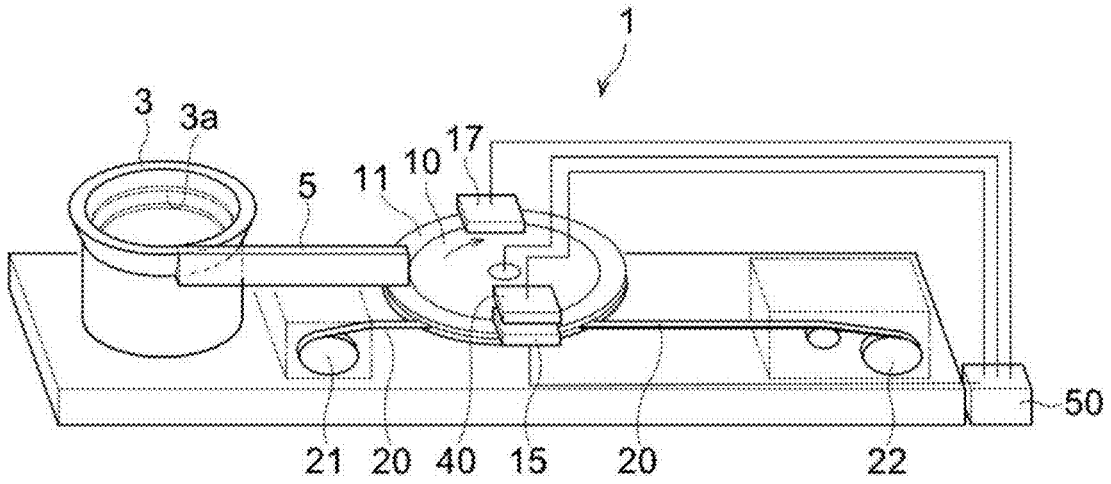
FIG. 1 is an oblique perspective view showing an example of a taping device schematically.
Figure 2:
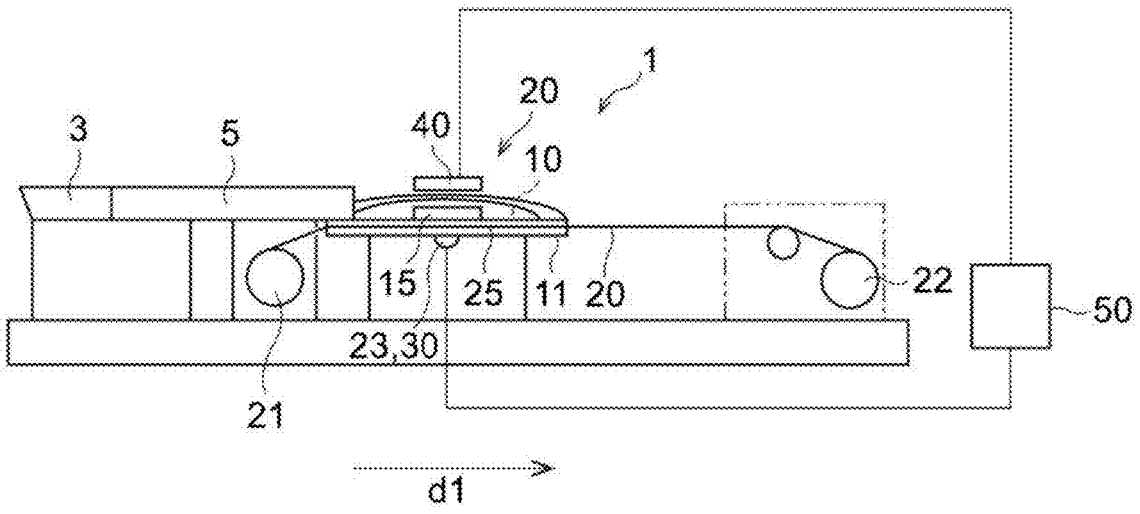
FIG. 2 is a front view showing an example of a taping device schematically.
Figure 3:
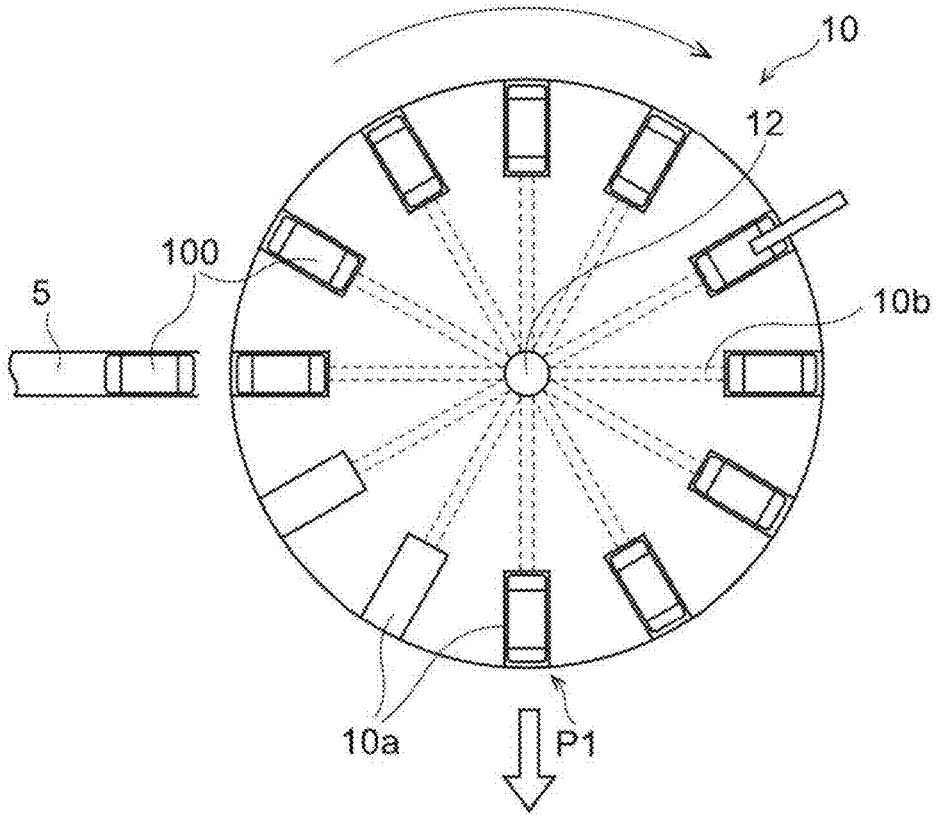
FIG. 3 is a top view showing an example of an index table.
Figure 4:
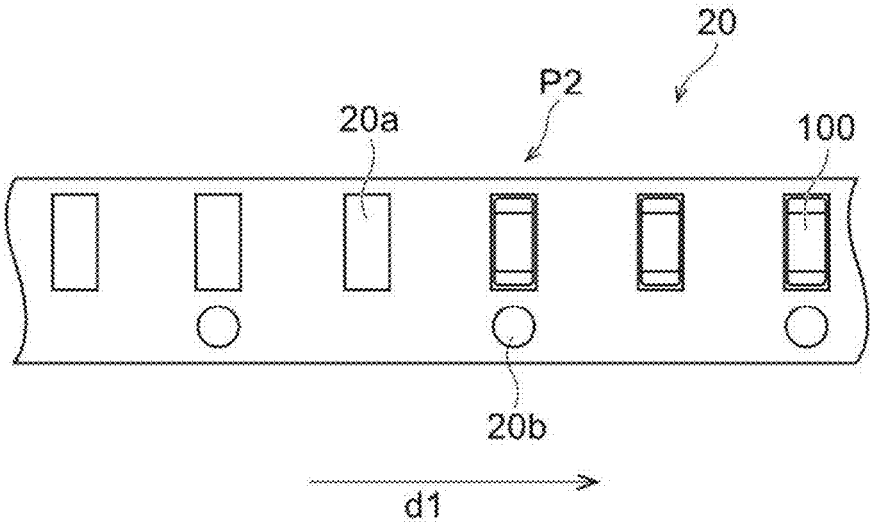
FIG. 4 is a top view showing an example of a carrier tape.

FIG. 1 is an oblique perspective view showing an example of a taping device 1 schematically. FIG. 2 is a front view showing an example of a taping device 1 schematically. FIG. 3 is a top view showing an example of an index table 10. FIG. 4 is a top view showing an example of a carrier tape 20.

The taping device 1 accommodates workpieces 100, such as electronic components, in a plurality of cavities 20*a* of a carrier tape 20, respectively. The taping device 1 shown in FIGS. 1 and 2 comprises: an index table 10; a carrier tape 20 that is sent through a place adjacent to the index table 10; a guide unit 15 that is provided to overlap with a portion of the index table 10 and a portion of the carrier tape 20 in the height direction; and a pulley 30 positioned to face the guide unit 15. Further, the taping device 1 comprises: a first driving unit 12 (see FIG. 3) that drives the index table 10; a second driving unit 23 (see FIG. 2) that sends the carrier tape 20 in the longitudinal direction d1; an imaging device 40 that captures an image of a portion of the carrier tape 20; and a control unit 50 that controls at least the first driving unit (table driving unit) 12, the second driving unit (tape driving unit) 23 and the imaging device 40. Furthermore, the taping device 1 comprises: a parts feeder 3 and a linear feeder 5 that supply workpieces 100 to the index table 10; a supply reel 21 that sends out the carrier tape 20; and a roll-up reel 22 that collects the carrier tape 20.

The parts feeder 3 has an opening and aligns a plurality of workpieces 100 supplied through the opening while aligning the orientation of the plurality of workpieces 100. The parts feeder 3 has a substantially cylindrical shape with a circular opening in the example shown in FIG. 1, but may have an opening of any shape. The parts feeder 3 in the present example has a vibrating device, not shown in the drawings, and a groove section 3*a*, and in particular, the groove section 3*a* of the parts feeder 3 of the present example, which has a substantially cylindrical shape, extends in a spiral or vortex shape. Vibration of the vibrating device causes a plurality of workpieces 100 to gradually move along the groove section 3*a*, and as a result, the plurality of workpieces 100 supplied to the parts feeder 3 are aligned along the groove section 3*a* in aligned orientation. The plurality of workpieces 100 thus aligned are sent from the parts feeder 3 to the linear feeder 5.

The linear feeder 5 receives a plurality of aligned workpieces 100 from the parts feeder 3 and conveys the plurality of workpieces 100 in a state where the plurality of workpieces 100 form a line. The linear feeder 5 has a groove section (not shown in the drawings) that is connected to the groove section 3*a* of the parts feeder 3 and extends in a straight line, and conveys workpieces 100 along the groove section. A plurality of workpieces 100 that have sequentially passed through the linear feeder 5 are each individually supplied to an accommodation section 10*a* of the index table 10 in the same orientation as each other, as shown in FIG. 3.

The index table 10 has a plurality of accommodation sections 10*a* in which workpieces 100 are to be accommodated. A plurality of workpieces 100 are transported by the index table 10 in a state where the plurality of workpieces 100 are housed in separate accommodation sections 10*a* respectively. The index table 10 in the present example is provided on a base 11, has a disk shape (e.g., a disk shape having a circular flat surface with a diameter of 60 mm or more and 80 mm or less) and has a plurality of accommodation sections 10*a* provided at equal intervals along the outer circumference, and workpieces 100 supplied from the linear feeder 5 are each individually housed in an accommodation section 10*a*. The base 11 is provided with a work holding magnet (see a reference numeral "37" in FIG. 6 described later), and a workpiece 100 (in particular, a magnetic material) in each accommodation section 10*a* is attracted by the magnetic force of the work holding magnet, thereby preventing the workpieces 100 from being separated and released from the respective accommodation sections 10*a*.

Each accommodation section 10*a* can accommodate one workpiece 100. The dimensions of an accommodation section 10*a* are set appropriately according to the dimensions of a workpiece 100. As an example, each accommodation section 10*a* is provided as a substantially rectangular shaped recess having a length of 0.6 mm or more and 2.0 mm or less in the diameter direction of the index table 10 and a length of 0.38 mm or more and 1.5 mm or less in the circumferential direction of the index table 10. In this case, the spacing between the accommodation sections 10*a* along the circumferential direction of the index table 10 can be set to 2.2 mm or more and 4.4 mm or less, for example.

The index table 10 is provided with a suction device, not shown in the drawings, for suctioning a workpiece 100. The suction device has, for example, a vacuum pump that performs vacuuming through each of the accommodation sections 10*a*. The vacuum pump draws a vacuum in each of the accommodation sections 10*a* through a suction connection channel (see reference numeral "33" in FIG. 6 below) and a nozzle 10*b* in such a manner that a workpiece 100 is suctioned from the linear feeder 5 towards the accommodation section 10*a*.

A workpiece 100 in each accommodation section 10*a* is conveyed with the rotation of the index table 10 and is released from the index table 10 at the predetermined release position P1. Specifically, a workpiece 100 is released from an accommodation section 10*a* toward a cavity 20*a* of a carrier tape 20 at the release position P1 where the accommodation section 10*a* housing the workpiece 100 is closest to the carrier tape 20.

The base 11 is equipped with a release device, not shown in the drawings, for releasing a workpiece 100 from an accommodation section 10*a*. The release device may be, for example, an air blowing device that ejects an air stream toward an accommodation section 10*a* positioned at the release position P1, and a workpiece 100 is released from the accommodation section 10*a* at the release position P1 by the air stream. Regardless of whether or not air is jetted out from the release device, the vacuum pump may continue to draw a vacuum in each of the accommodation sections 10*a*. In this case, the air is blown out from the release device so as to exert on a workpiece 100 a force that overcomes the suction of the workpiece 100 in each accommodation section 10*a* by the vacuum pump.

The base 11 supports the index table 10 in a rotatable manner. The base 11 has an inclined surface 11*s* (see FIGS. 5 and 6) that is sloped in such a manner that the supply position P2 side of the inclined surface 11*s* is the lowest in the vertical direction. The index table 10 extends along the inclined surface 11*s*. The inclined surface 11*s* is preferably a flat plane. The angle of inclination of the inclined surface 11*s* is preferably constant, and the inclined surface 11*s* is inclined, for example, at an angle of 20° or more and 40° or less, preferably 25° or more and 35° or less, with respect to the horizontal direction.

The first driving unit (table driving unit) 12 shown in FIG. 3 drives and rotates the index table 10 under the control of the control unit 50 to sequentially position the plurality of accommodation sections 10*a* at the release position P1. The first driving unit 12 intermittently rotates the index table 10 clockwise in FIG. 3 in the present example, but may also drive and rotate the index table 10 counterclockwise instead of or in addition to the clockwise rotation.

A characteristic measurement unit 17 is installed peripherally in the index table 10 (see FIG. 1; not show in FIGS. 2 and 3). The characteristic measurement unit 17 measures a characteristic of a workpiece 100 housed in each of the accommodation sections 10*a* and transmits the measurement results to the control unit 50. When measuring a characteristic of a workpiece 100, the characteristic measurement unit 17 of the present embodiment brings measurement probes into contact with both end electrodes of the workpiece 100 (the leading side end portion on the base outer circumference side and the trailing side end portion on the base center side). The measurement probes are magnetizing probes, and both end electrodes of a workpiece 100 are each magnetized to a specific pole as the measurement probes contact the end electrodes. In other words, the characteristic measurement unit 17 also works as a magnetizing device that magnetizes both end electrodes (the leading and trailing side end portions) of workpieces 100 to specific poles before the workpieces 100, which are stored in the plurality of accommodation sections 10*a* of the index table 10, reach the release position P1.

When a characteristic of a workpiece 100 is determined to be defective based on a measurement result of the characteristic measurement unit 17, the control unit 50 may discharge the defective workpiece 100 to a discharge device (not shown in the drawings) before the defective workpiece 100 reaches the release position P1. In this case, it is possible to prevent a defective workpiece 100 from being supplied to the carrier tape 20 and to supply only workpieces 100 having good characteristics to the carrier tape 20.

The carrier tape 20 is a strip-shaped member having a plurality of cavities 20*a* that are arranged in a row at equal intervals in the direction of its extension (longitudinal direction d1) and extending adjacent to the index table 10. The carrier tape 20 in the present example is positioned vertically lower than the index table 10, and gravity is used to transfer and supply a workpiece 100 from an accommodation section 10*a* of the index table 10 (in particular, from an accommodation section 10*a* positioned at the release position P1) to a cavity 20*a* of the carrier tape 20 (in particular, to a cavity 20*a* positioned at the supply position P2).

The dimensions of the carrier tape 20 (including the cavities 20*a*) can be set as desired. The carrier tape 20 may, as an example, have a tape length (i.e., a length in the longitudinal direction d1) of 3200 m or more and 4800 m or less, a width (i.e., a length in a direction perpendicular to the longitudinal direction d1) of 8 mm or more and 12 mm or less, and a thickness of 0.42 mm or more and 1.8 mm or less. Further, each cavity 20*a* may be provided as a recess having a rectangular planar shape having, as an example, a length of 0.37 mm or more and 1.5 mm or less in the longitudinal direction d1, and a length of 0.67 mm or more and 2.22 mm or less in the direction perpendicular to the longitudinal direction d1, and a depth of 0.37 mm or more and 1.54 mm or less. Further, the spacing in the longitudinal direction d1 between adjacent cavities 20*a* may be set to be, for example, 2 mm or more and 4 mm or less.

The portion of a carrier tape 20 before workpieces 100 are accommodated is held wound onto a supply reel 21 upstream from the guide unit 15 with respect to the longitudinal direction d1. The carrier tape 20 is fed to the guide unit 15 while being unwound from the supply reel 21.

The portion of the carrier tape 20 accommodating workpieces 100 receives the attachment of a top tape in such a manner that cavities 20*a* are sealed by the top tape, and after that, is wound up and collected by the roll-up reel 22 together with the top tape downstream from the guide unit 15 with respect to the longitudinal direction d1. The carrier tape 20 is driven by the second driving unit 23 and sent in the longitudinal direction d1. Although the top tape and the top tape attachment device for attaching the top tape to the carrier tape 20 are omitted from the drawings, those skilled in the art could easily recognize and realize an arrangement example and a configuration example of the top tape and the top tape attachment device.

The second driving unit (tape driving unit) 23 intermittently conveys the carrier tape 20 in the longitudinal direction (tape conveyance direction) d1 under the control of the control unit 50 so as to sequentially position a plurality of cavities 20*a* that the carrier tape 20 has in the supply position P2. The second driving unit 23 in the present example has a pulley 30, and the rotation of the pulley 30 moves the carrier tape 20 in the longitudinal direction d1.

The pulley 30 positions the carrier tape 20 in the appropriate position. The pulley 30 is located facing the guide unit 15. Preferably, the pulley 30 is located below the supply position P2 in the vertical direction. The pulley 30 is substantially disk-shaped and can rotate about its center. The pulley 30 is connected to a driving source, not shown in the drawings, and is rotated by the power output from the driving source.

The pulley 30 has a plurality of feed teeth (see reference numeral "30*a*" in FIG. 6 described below) provided at equal intervals on its outer circumference. The plurality of feed teeth engage a plurality of feed holes 20*b* provided in the carrier tape 20. By the engagement of a feed tooth with a feed hole 20*b*, the position of the carrier tape 20 can be moved slightly with respect to the pulley 30. In this way, the position of the carrier tape 20 with respect to the pulley 30 can be set to an appropriate position. In particular, the position of the carrier tape 20 relative to the pulley 30 in a direction perpendicular to the longitudinal direction d1 of the carrier tape 20 can be set to an appropriate position. The spacing between the feed teeth along the circumference of the pulley 30 corresponds to the spacing between the feed holes 20*b* in the carrier tape 20, and even if one feed tooth detaches from a feed hole 20*b* in the carrier tape 20, another feed tooth engages another feed hole 20*b*. In other words, a state where at least one feed tooth engages a feed hole 20*b* of the carrier tape 20 is kept. The sequential engagement of the feed teeth with the feed holes 20*b* transmits the rotational power of the pulley 30 to the carrier tape 20, thereby sending the carrier tape 20.

Each of the feed teeth (in particular, the tip portion) of the pulley 30 has an involute curve shape in the cross section along the longitudinal direction d1. Each feed tooth has a tapered shape in the cross section along a direction perpendicular to the longitudinal direction d1. Specifically, in the cross section along the direction orthogonal to the longitudinal direction d1, the width of a feed tooth changes to become smaller as it is away from the center of the pulley 30. Preferably, in the cross section along the direction orthogonal to the longitudinal direction d1, the width of a feed tooth varies in such a manner that the width of a section of a feed tooth decreases at a constant rate as the section of a feed tooth is away from the center of the pulley 30. In other words, in the cross section along the direction orthogonal to the longitudinal direction d1, the sides of the feed teeth each have a straight shape. The slope angle θ of this tapered shape is preferably 10° or more and 40° or less, and more preferably 20° or more and 30° or less. The taper degree is the angle in the direction in which a feed tooth extends, i.e., in the direction in which the tip portion of the tapered shape extends with respect to the pulley 30 taper.

When each feed tooth engages a feed hole 20*b* and when each feed tooth disengages from a feed hole 20*b*, a portion of each feed tooth that is tapered in the cross section along a direction perpendicular to the longitudinal direction d1 and that has an involute curve shape in the cross section along the longitudinal direction d1, push out the peripheral wall of a feed hole 20*b*.

Further, each feed tooth is rectangular when observed from the outer circumference of the pulley 30. The length of a diagonal line of this rectangle, that is, the longest length of a feed tooth observed from the outer circumference of the pulley 30, is larger than the diameter of a feed hole 20*b*. Therefore, a feed tooth engages a feed hole 20*b* while the feed tooth pushes out the feed hole 20*b* so as to expand the feed hole 20*b*.

The guide unit 15 guides a workpiece 100 released from the index table 10 to supply the workpiece 100 to the carrier tape 20, so that the workpiece 100 is accommodated in a cavity 20*a*. As shown in FIG. 1, the guide unit 15 in the present example is provided to overlap with a portion of the index table 10 and a portion of the carrier tape 20 in the height direction, so that the guide unit 15 covers the portion of the index table 10 and the portion of the carrier tape 20.

Figure 5:
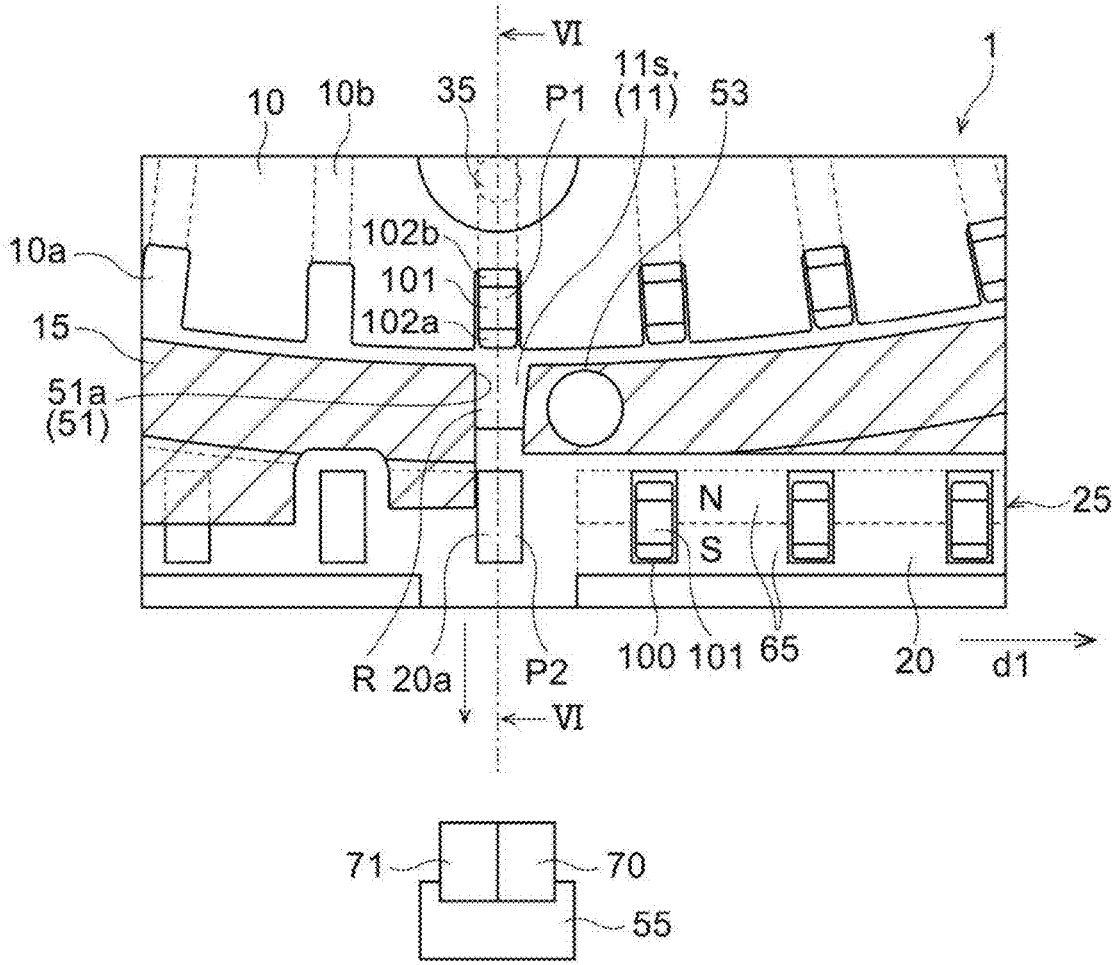
FIG. 5 shows an enlarged top view of an example of a taping device.
Figure 6:
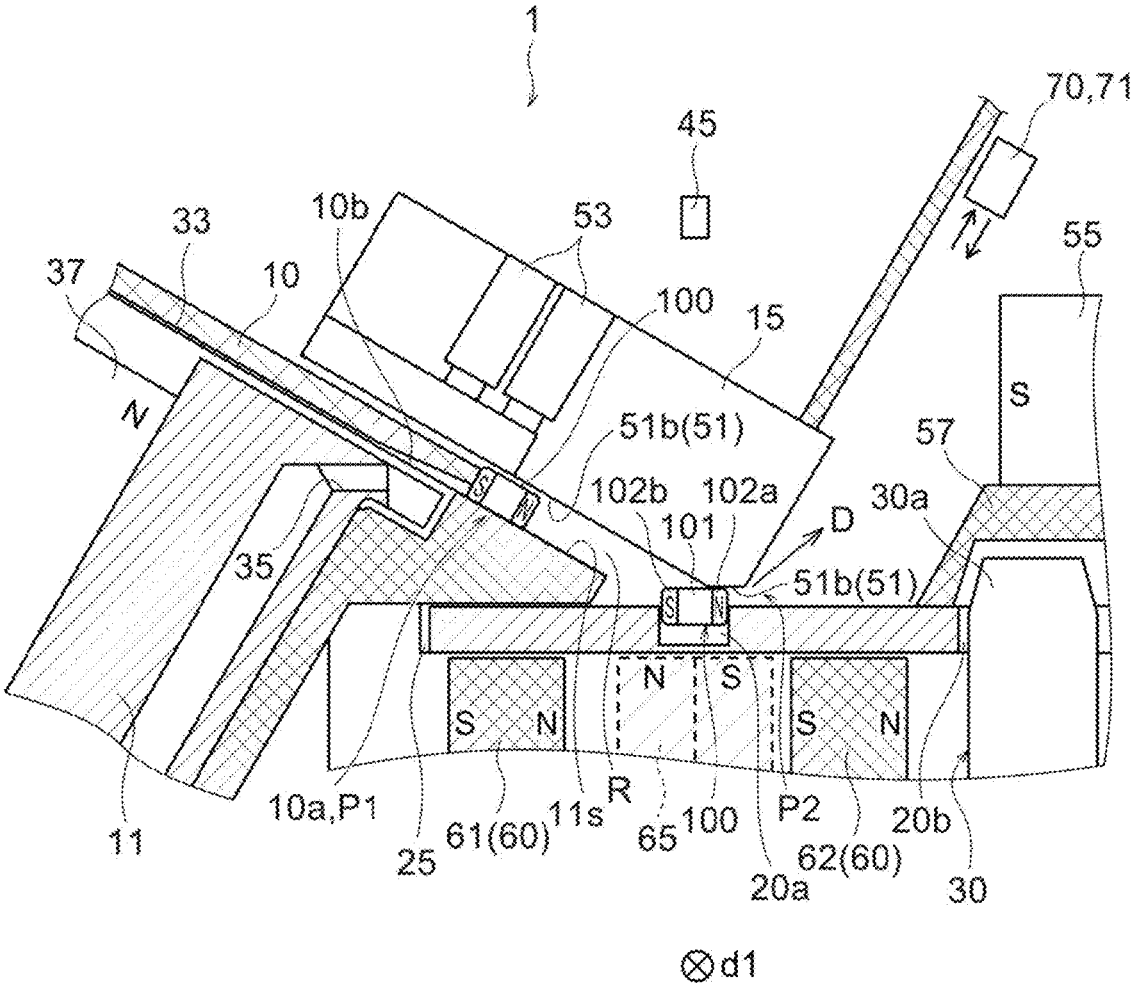
FIG. 6 is a cross sectional view of the taping device along a VI-VI line of FIG. 5.

FIG. 5 shows an enlarged top view of one example of the taping device 1. FIG. 6 is a cross sectional view of the taping device 1 along the line VI-VI in FIG. 5.

The guide unit 15 guides a workpiece 100 having been released from the index table 10 to be supplied to the carrier tape 20 positioned in a tape passage 25 and to be inserted into a cavity 20*a* positioned at the supply position P2.

As shown in FIGS. 5 and 6, the guide unit 15 has a guide surface (i.e., a reference surface) 51 that demarcates at least a portion of a workpiece path (guideway) R. A workpiece 100 having been released from the index table 10 (release position P1) is guided into a cavity 20*a* by the guide surfaces 51. The guide surface 51 in the present example includes a lateral guide surface 51*a* (see FIG. 5) and an upper guide surface 51*b* (see FIG. 6). The normal direction of the lateral guide surface 51*a* is a horizontal direction. The upper guide surface 51*b* includes a potion extends generally parallel to the inclined surface 11*s* of the base 11. The upper guide surface 51*b* shown in FIG. 6 includes an upper portion that extends parallel to the inclined surface 11*s* of the base 11 and a lower portion that is connected to the lower section of the upper portion and extends in a horizontal direction at the supply position P2.

The lateral guide surface 51*a* shown in FIG. 5 is a surface forming the reference for positioning a cavity 20*a* of the carrier tape 20 at the supply position P2. In the present embodiment, a cavity 20*a* positioned at the supply position P2 is aligned with the lateral guide surface 51*a* when a workpiece 100 is inserted into the cavity 20*a*. The guide surfaces 51 including the lateral guide surface 51*a* and the upper guide surface 51*b* is provided to cover an accommodation section 10*a* positioned at the release position P1 and a cavity 20*a* positioned at the supply position P2.

The inclined surface 11*s* of the base 11 and the guide surfaces 51 (the lateral guide surface 51*a* and the upper guide surface 51*b*) of the guide unit 15 demarcate the workpiece path R between the release position P1 and the supply position P2. The air jet from the release device (not shown in the drawings) acts on a workpiece 100 through the moving unit 35 and a nozzle 10*b*, so that the workpiece 100 is released from an accommodation section 10*a* positioned at the release position P1 to move linearly along the workpiece path R to the supply position P2.

At least a part of the guide unit 15 is transparent in such a manner that capturing an image by the imaging device 40 can be performed through the guide unit 15. Specifically, the guide unit 15 is formed by a material that can transmit the imaging light to be received by the imaging device 40 for image capturing in the portion of the guide unit 15 overlapping with the supply position P2 (including the portion that defines the workpiece path (guideway) R). This enables the imaging device 40 to acquire an image of the supply position P2 through the guide unit 15, and to image a cavity 20*a* of the carrier tape 20 placed at the supply position P2. The at least a part of the guide unit 15, which is transparent, is composed of a material having visible light transmittance, such as glass material.

Further, the guide unit 15 is provided with air intake holes 53 that allow ventilation between the workpiece path R and the outside of the guide unit 15. When air is drawn from the workpiece path R by the suction device 70, air flows into the workpiece path R through the air intake holes 53. This creates an air flow in the workpiece path R from the release position P1 towards the supply position P2. A workpiece 100 is encouraged to move in the workpiece path R toward the supply position P2 by riding this air flow.

A first moving magnet 61 and a second moving magnet 62 that are located below the tape passage 25 through which the carrier tape 20 passes, are provided in the vicinity of the supply position P2, as magnets 60 for workpiece insertion (see FIG. 6). The magnets 60 for workpiece insertion (the first moving magnet 61 and the second moving magnet 62) are formed by, for example, neodymium magnets, and exert magnetic force to position a workpiece 100 containing a magnetic material 101 in a cavity 20*a* positioned at the supply position P2. In particular, in order to cause a workpiece 100 to be inserted into a cavity 20*a* in a proper orientation, the magnets 60 for workpiece insertion are arranged to form a magnetic field along the direction in which the workpiece 100 is to be inserted in the cavity 20*a* of the carrier tape 20, for example, along the longitudinal direction of the cavity 20*a*, that is, the direction orthogonal to the longitudinal direction d1 of the carrier tape 20. In the example shown in FIG. 6, the magnets 60 for workpiece insertion includes: the first moving magnet 61 disposed on the side of the release position P1 with respect to the supply position P2; and the second moving magnet 62 disposed on the opposite side from the release position P1 with respect to the supply position P2. In other words, the first moving magnet 61 and the second moving magnet 62 are arranged so that the supply position P2 is positioned between the first moving magnet 61 and the second moving magnet 62 in the top view. By appropriately separating the first moving magnet 61 and the second moving magnet 62, an appropriate magnetic field can be formed in the cavity 20*a*, and as an example, the distance between the first moving magnet 61 and the second moving magnet 62 is 2 mm or more and 3 mm or less.

The magnetic pole of the side of the first moving magnet 61 facing the second moving magnet 62 is different from that of the side of the second moving magnet 62 facing the first moving magnet 61. In other words, the first moving magnet 61 and the second moving magnet 62 are arranged so that the different magnetic poles face each other. A workpiece 100 to be positioned in the release position P1 is pre-magnetized in a specific direction, and a workpiece 100 in the example shown in FIG. 6 is positioned in the release position P1 in such a manner that the right end has an N pole and the left end has an S pole. This method of magnetizing a workpiece 100 is not limited. In the present embodiment, in the upstream from the release position P1, the characteristic measurement unit 17 (see FIG. 1) magnetizes the electrodes 102*a*, 102*b* of each workpiece 100 conveyed by the index table 10 to specific poles respectively while inspecting each workpiece 100 as described above.

Magnets 65 for workpiece holding during transport are arranged, vertically below the tape passage 25, at a place that is distanced from the supply position P2 (in particular, a position downstream from the supply position P2 with respect to the longitudinal direction d1 of the carrier tape 20). The magnets 65 for workpiece holding during transport particularly exert a magnetic force on workpieces 100 in cavities 20*a* adjacent downstream to a cavity 20*a* positioned at the supply position P2. The magnets 65 for workpiece holding during transport exerts a magnetic force on workpieces 100 in cavities 20*a* so as to inhibit the workpieces 100 from popping out of the cavities 20*a* or tilting in the cavities 20*a*.

The suction device 70 is provided on the opposite side from the workpiece path R with respect to cavities 20*a* of the carrier tape 20 and has, for example, a vacuum pump. The suction device 70 draws air in the workpiece path R and creates a flow of air from the release position P1 to the supply position P2 in the workpiece path R. In particular, the air from the release device (not shown in the drawings) is jetted to a nozzle 10*b* via the moving unit 35 while the air is sucked by the suction device 70, thereby creating a strong flow of air from the release position P1 to the supply position P2 in the workpiece path R. The stronger this air flow, the more strongly a workpiece 100 is encouraged to move from the release position P1 to the supply position P2, and the more reliably a workpiece 100 discharged from an accommodation section 10*a* at the release position P1 is supplied via the workpiece path R to a cavity 20*a* positioned at the supply position P2.

Thus, the release device and the suction device 70 of the present embodiment function as a workpiece transfer device that exerts a propulsive force on a workpiece 100 in such a manner that the workpiece 100 in an accommodation section 10*a* positioned at the release position P1 is moved via the workpiece path (guideway) R to a cavity 20*a* positioned at the supply position P2. In other words, the release device that blows gas (air) into an accommodation section 10*a* positioned at the release position P1 to create positive pressure and the suction device 70 that creates negative pressure by suction serve as a workpiece transfer device that adjusts the air pressure in at least one or more of the accommodation section 10*a*, the workpiece path (guideway) R and a cavity 20*a* to exert a propulsive force on a workpiece 100.

In the present embodiment, a return blowing device 71 is provided near the suction device 70. The return blowing device 71 can jet gas (e.g., air) under the control of the control unit 50 to move a workpiece 100 supplied to a cavity 20*a* positioned at the supply position P2 toward the workpiece path (guide way) R. The suction device 70 and the return blowing device 71 are connected to the workpiece path R via a common gas flow path. The suction device 70 can create an air flow from the workpiece path R towards a cavity 20*a* positioned at the release position P1. On the other hand, the return blowing device 71 can create an air flow from a cavity 20*a* positioned at the release position P1 towards the workpiece path R. The suction device 70 always suctions gas to operate to create negative pressure, while the return blowing device 71 blows out gas temporarily (e.g., momentarily) as needed under the control of the control unit 50 to operate to create positive pressure.

Further, in the present embodiment, an insertion sensor 45 (see FIG. 6) is provided to detect whether or not a workpiece 100 is supplied to a cavity 20*a* positioned at the supply position P2, and the detection results of the insertion sensor 45 are transmitted to the control unit 50. The insertion sensor 45 in the example shown in FIG. 6 is provided on the opposite side in the height direction from the supply position P2 via the guide unit 15, and detects whether or not a workpiece 100 is supplied to a cavity 20*a* positioned at the supply position P2 via the guide unit 15. For example, at least a portion of the guide unit 15 that is positioned between the insertion sensor 45 and the supply position P2 may be composed of a member that can transmit the light used for detection (e.g., of a transparent member).

The specific detection method by the insertion sensor 45 is not limited. As an example, the insertion sensor 45 may comprise an imaging device capable of capturing images of a portion of the carrier tape 20 positioned at the supply position P2 (and thus a cavity 20*a* and a workpiece 100 positioned at the supply position P2). In this case, the insertion sensor 45 or the control unit 50 may analyze image data captured by the imaging device to detect whether a workpiece 100 has been supplied to a cavity 20*a* positioned at the supply position P2. As another example, the insertion sensor 45 may have a light emitting unit that emits a detection light toward the supply position P2 and a light receiving unit that can receive the detection light from the supply position P2. The insertion sensor 45 may be of the transmitted light detection type where only one of the light emitting unit and the light receiving unit is provided at the position shown in FIG. 6, for example, or may be of the reflected light detection type where both (the light emitting unit and the light receiving unit) are provided.

In the case of the transmitted light detection type insertion sensor 45, one of the light emitting and light receiving units is provided at the position shown in FIG. 6, and the other is provided on the opposite side from the position indicated by reference numeral "45" in FIG. 6 with respect to the supply position P2 (in other words, the other is provided opposite the position "45", with the supply position P2 located between them). In this case, the control unit 50 determines that while the light receiving unit is receiving the detection light, a workpiece 100 is not supplied to a cavity 20*a* of the supply position P2. On the other hand, while the light receiving unit is not receiving the detection light, the detection light is considered to be obstructed by a workpiece 100 placed in a cavity 20*a* positioned at the supply position P2, and the control unit 50 may determine that a workpiece 100 is supplied to a cavity 20*a* at the supply position P2. On the other hand, in the case of the reflected light detection type insertion sensor 45, the control unit 50 determines that while the light receiving unit is receiving the detection light, a workpiece 100 is supplied to a cavity 20*a* positioned at the supply position P2. On the other hand, while the light receiving unit is not receiving the detection light, the control unit 50 may determine that a workpiece 100 is not supplied to a cavity 20*a* positioned at the supply position P2.

The imaging device 40 is capable of capturing images of a cavity 20*a* before, during and/or after a workpiece 100 is supplied to the cavity 20*a*, through the guide unit 15. The imaging device 40 of the present embodiment acquires an image of at least a portion of a workpiece 100 has been supplied to a cavity 20*a* positioned at the supply position P2.

The control unit 50 receives captured images from the imaging device 40, analyzes the captured images, and determines the state of a workpiece 100 supplied to a cavity 20*a* and the state of the carrier tape 20 based on the analysis results of the captured images.

The taping device 1 (workpiece insertion apparatus) of the present embodiment, which inserts a workpiece 100 into a cavity 20*a* of the carrier tape 20 at the supply position P2 as described above, further comprises a posture correction magnet 55, in addition to the base 11, the index table 10, the guide unit 15 and the workpiece transfer device (the release device and the suction device 70) described above.

The posture correction magnet 55 exerts a magnetic force working in an attraction direction D including an upward direction component on the leading side end (the first electrode 102*a* shown in FIGS. 5 and 6) of the ends of a workpiece 100 that is positioned at the supply position P2, and the leading side end is positioned on the cavity 20*a* side when the workpiece 100 is on the inclined surface 11*s*. The posture correction magnet 55 in the present example is placed on a support stand 57 in such a manner that the posture correction magnet 55 is positioned on the same side as the suction device 70 with respect to the supply position P2, as shown in FIG. 6, and at an angle upward with respect to the supply position P2 (thus, for example, with respect to a cavity 20*a* positioned at the supply position P2). The posture correction magnet 55 shown in FIG. 6 is located on the opposite side from the pulley 30 (in particular, from a feed tooth 30*a* in the state of being inserted into a feed hole 20*b*) via the support stand 57.

Each workpiece 100 is magnetized by the characteristic measurement unit 17 before reaching the release position P1 as described above, and in the present embodiment, is positioned at the release position P1 in a state where the leading side end (first electrode 102*a*) has an N pole and the trailing side end (second electrode 102*b*) has an S pole. Therefore, the posture correction magnet 55 is positioned in such a manner that the S pole of the posture correction magnet 55 is directed toward the first electrode 102*a* of a workpiece 100 when the workpiece 100 is positioned at the supply position P2 in order to magnetically attract the leading side end (first electrode 102*a*) of the workpiece 100, magnetized to N pole, in the attraction direction D.

With the taping device 1 having the configuration described above, each workpiece 100 contacts a recessed surface (in particular, the side surface) of the carrier tape 20 that defines a cavity 20*a* at the supply position P2 while receiving the air current (propulsive force) created by the workpiece transfer device (the release device and the suction device 70). Furthermore, each workpiece 100 contacts the guide surface 51 of the guide unit 15 from below and is supported by the guide surface 51 at the supply position P2 while receiving the magnetic force exerted in the attraction direction D (including the upward direction component) by the posture correction magnet 55.

Thus, the workpiece transfer device (the release device and the suction device 70) and the posture correction magnet 55 exert propulsive and magnetic forces on a workpiece 100 to cause the workpiece 100 to float from the carrier tape 20 at the supply position P2 while at least part of the workpiece 100 is positioned inside a cavity 20*a*. Further, the guide surface 51 of the guide unit 15 (in the example shown in FIG. 6, a part of the upper guide surface 51*b* which extends horizontally) supports the upper surface of a workpiece 100 at the supply position P2 in such a manner that the workpiece 100 on which the propulsive force and magnetic force are applied takes a horizontal posture. Further, a recessed surface of the carrier tape 20 (in the example shown in FIG. 6, the side surface extending in a generally vertical direction (the height direction)) supports a side surface of a workpiece 100 at the supply position P2 in such a manner that the workpiece 100 on which the propulsive and magnetic forces are applied assumes a horizontal posture. Furthermore, in the taping device 1 in the present example, the magnets 60 for workpiece insertion (the first moving magnet 61 and the second moving magnet 62) exert magnetic forces on both end electrodes 102*a* and 102*b* of a workpiece 100 at the supply position P2 in such a manner that the workpiece 100 takes a horizontal posture.

As a result, a workpiece 100 positioned at the supply position P2 can stably assume a desired horizontal posture in a state where at least part of the workpiece 100 is situated in a cavity 20*a* and the entire workpiece 100 is floating.

Then, a workpiece 100 is sent downstream from the supply position P2 while at least part of the workpiece 100 is positioned inside a cavity 20*a* as the carrier tape 20 moves downstream, and lands in the cavity 20*a* downstream from the supply position P2. In other words, as a result of a workpiece 100 having moved downstream from the supply position P2, the workpiece 100 is released from the propulsive and magnetic forces provided by the workpiece transfer device (the release device and the suction device 70), the posture correction magnet 55 and the workpiece insertion magnets 60 (the first moving magnet 61 and the second moving magnet 62) described above, so that the workpiece 100 lands in the cavity 20*a* under the influence of gravity. In particular, in the taping device 1 of the present example, the magnets 65 for workpiece holding during transport, which are provided downstream from the supply position P2 and below the tape passage 25, exert a magnetic force (attraction force) on a workpiece 100 (in particular, on both end electrodes 102*a* and 102*b*). As a result, a workpiece 100 can land securely and stably in a cavity 20*a* downstream from the supply position P2, and is sent further downstream along with the carrier tape 20 while maintaining such a landing state.

The taping device 1 of the present embodiment having the configuration described above can put a large number of workpieces 100 into a plurality of cavities 20*a* of the carrier tape 20 and seals the large number of workpieces 100 with the carrier tape 20 and the top tape (not shown in the drawings) by means of various constituent devices of the taping device 1 working together under appropriate control by the control unit 50.

As explained above, according to the present embodiment, workpieces 100 are effectively corrected in posture by receiving from the posture correction magnet 55 a magnetic force working in the attraction direction D including an upward direction component at a cavity 20*a* positioned at the supply position P2.

Since a workpiece 100 moves from the release position P1 to the supply position P2 through the workpiece path R, which extends obliquely downward (in the downward direction to the right in the example shown in FIG. 6), a workpiece 100 tends to enter a cavity 20*a* in a state where the workpiece 100 is inclined (in particular, in an inclined posture where the leading side end (the first electrode 102*a*) is positioned lower than the trailing side end (the second electrode 102*b*)). In particular, the greater the propulsive force that causes a workpiece 100 to move from the release position P1 to the supply position P2 (e.g., the greater the suction force of the suction device 70), the more vigorously the workpiece 100 enters a cavity 20*a* positioned at the supply position P2, so that the workpiece 100 tends to assume an unintended inclined posture in the cavity 20*a*.

On the other hand, according to the taping device 1 of the present embodiment, such an inclined posture of a workpiece 100 is corrected to a horizontal posture, because the posture correction magnet 55 exerts a magnetic force working in the attraction direction D including an upward direction component on the leading side end (the first electrode 102*a*) of the workpiece 100.

In particular, the portion of the guide surface 51 of the guide unit 15 that faces a cavity 20*a* positioned at the supply position P2 (in particular, the portion of the upper guide surface 51*b* that is the lowest) has a support surface that extends in a direction corresponding to a desired orientation of a workpiece 100 (i.e. in the horizontal direction). A workpiece 100 supported by the guide surface 51 (the upper guide surface 51*b*) can stably maintain the desired horizontal posture in a state where at least part of the workpiece 100 is positioned in a cavity 20*a* of the supply position P2.

Further, a workpiece 100 is at least partially accommodated in a cavity 20*a* in a floating state at the supply position P2, and is made to land in the cavity 20*a* at the downstream side than the supply position P2. This enables smooth posture correction of a workpiece 100 at the supply position P2, while a workpiece 100 can be stably accommodated in a cavity 20*a* in an appropriate posture at the downstream side from the supply position P2.

Variant Examples

The workpiece insertion magnets 60 (the first moving magnet 61 and the second moving magnet 62; see FIG. 6) may not be installed. Even in such a case, the other workpiece posture correction devices described above (e.g., the workpiece transfer device (the release device and the suction device 70), the posture correction magnet 55 and the guide unit 15, etc.) can properly correct the posture of a workpiece 100 to be housed in a cavity 20*a*, and in turn, a workpiece 100 can be housed in a cavity 20*a* in a stable posture.

It should be noted that the embodiments and the variant examples disclosed in the present specification are illustrative only in all respects and are not to be construed as limiting. The above-described embodiments and variant examples may be omitted, substituted and modified in various forms without departing from the scope and intent of the attached claims. For example, the above-described embodiments and variant examples may be combined in whole or in part, and embodiments other than those described above may be combined with the above-described embodiments or variant examples. In addition, the effects of the present disclosure technology described in the present specification are illustrative only, and other effects may be brought about.

The technical categories in which the above-described technical ideas are embodied are not limited. For example, the technical ideas described above may be embodied by a computer program for causing a computer to execute one or more procedures (steps) included in a method for manufacturing or using the devices described above. Further, the above-described technical ideas may also be embodied by a computer-readable non-transitory recording medium on which such a computer program is recorded.

The invention claimed is:

1. A workpiece insertion apparatus that inserts workpieces into cavities of a carrier tape at a supply position, the workpiece insertion apparatus comprising:

a base that has an inclined surface that is inclined in such a manner that a portion of the inclined surface on a supply position side is lowest in a vertical direction;

an index table that has a plurality of accommodation sections in which the workpieces are to be accommodated and extends along the inclined surface;

a guide unit that has a guide surface, the guide surface being provided to cover an accommodation section positioned at a release position and a cavity positioned at the supply position;

a workpiece transfer device that exerts a propulsive force on a workpiece in an accommodation section positioned at the release position to move the workpiece toward a cavity positioned at the supply position via a workpiece path defined by the inclined surface and the guide surface; and a posture correction magnet that exerts a magnetic force acting in an attraction direction including an upward direction component on a leading side end of ends of a workpiece that is positioned at the supply position, the leading side end being positioned on a cavity side when the workpiece is on the inclined surface, wherein the workpiece transfer device and the posture correction magnet apply the propulsive force and the magnetic force to the workpieces so that a workpiece floats from the carrier tape at the supply position while at least a part of the workpiece is positioned in a cavity, and the workpiece is sent downstream from the supply position while at least part of the workpiece is positioned in the cavity as the carrier tape moves, and the workpiece lands in the cavity on a downstream side from the supply position.

2. The workpiece insertion apparatus as defined in claim 1, comprising a workpiece insertion magnet that forms a magnetic field at the supply position, wherein the workpiece insertion magnet includes: a first moving magnet located on a release position side with respect to the supply position; and a second moving magnet located on an opposite side from the release position with respect to the supply position, and wherein a magnetic pole of a side of the first moving magnet facing the second moving magnet is different from a magnetic pole of a side of the second moving magnet facing the first moving magnet.

3. The workpiece insertion apparatus as defined in claim 1, wherein the guide surface supports a top surface of a workpiece in the supply position in such a manner that the workpiece assumes a horizontal posture while being subject to the magnetic force.

4. The workpiece insertion apparatus as defined in claim 1, comprising a magnetizing device that magnetizes the leading side end of each of the workpieces to a specific pole before the workpieces housed in the plurality of accommodation sections reach the release position.

5. The workpiece insertion apparatus as defined in claim 1, further comprising a return blowing device that jets gas to move the workpiece in the cavity positioned at the supply position toward the workpiece path, wherein the return blowing device and the workpiece transfer device are connected to the workpiece path via a common gas flow path.

6. The workpiece insertion apparatus as defined in claim 1, wherein the posture correction magnet is positioned at an angle upward with respect to the supply position, and is located on an opposite side from a pulley that conveys the carrier tape.

7. The workpiece insertion apparatus as defined in claim 1, wherein the leading side end of the workpiece is magnetized to a specific pole, and the posture correction magnet is arranged so that a magnetic pole having a pole different from the specific pole is directed toward the leading side end of the workpiece positioned at the supply position.

* * * * *